US009947486B2

(12) United States Patent
Kreutzer

(10) Patent No.: US 9,947,486 B2
(45) Date of Patent: Apr. 17, 2018

(54) SWITCH UNIT, IN PARTICULAR A CIRCUIT BREAKER

(71) Applicant: Siemens Aktiengesellschaft, Munich (DE)

(72) Inventor: Rainer Kreutzer, Weiden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/915,832

(22) PCT Filed: Jul. 8, 2014

(86) PCT No.: PCT/EP2014/064568
§ 371 (c)(1),
(2) Date: Mar. 1, 2016

(87) PCT Pub. No.: WO2015/036143
PCT Pub. Date: Mar. 19, 2015

(65) Prior Publication Data

US 2016/0203921 A1 Jul. 14, 2016

(30) Foreign Application Priority Data

Sep. 16, 2013 (EP) ..... 13184489

(51) Int. Cl.
*H01H 1/36* (2006.01)
*H01H 3/38* (2006.01)
(Continued)

(52) U.S. Cl.
CPC ..... *H01H 1/36* (2013.01); *H01H 3/38* (2013.01); *H01H 3/60* (2013.01);
(Continued)

(58) Field of Classification Search
CPC .. H01H 3/60; H01H 3/38; H01H 1/36; H01H 71/2409; H01H 73/045; H01H 1/50; H01H 71/2418; H01H 2001/508
(Continued)

(56) References Cited

U.S. PATENT DOCUMENTS 3,516,090 A 6/1970 Hurtle et al.
4,104,494 A * 8/1978 Swann ..... H01H 1/365 200/243
(Continued)

FOREIGN PATENT DOCUMENTS

CN 101542668 A 9/2009
CN 101546657 A 9/2009
(Continued)

*Primary Examiner* — Edwin A. Leon
*Assistant Examiner* — Iman Malakooti
(74) *Attorney, Agent, or Firm* — Cozen O'Connor

(57) ABSTRACT

A switch unit, preferably implementing a circuit breaker, includes a contact slide unit formed by a contact slide, a fixed contact piece and a moveable contact piece), and a short-circuit release that acts to displace the moveable contact piece by means of a tappet in the event of a short-circuit. A moveable braking device is configured and arranged such that, following circuit opening displacement of the moveable contact piece in response to a short-circuit, the moveable brake device dampens the return, rebound movement of the moveable contact piece to reclose the circuit.

8 Claims, 9 Drawing Sheets

(51) Int. Cl.

| | |
|---|---|
| ***H01H 3/60*** | (2006.01) |
| ***H01H 71/24*** | (2006.01) |
| ***H01H 73/04*** | (2006.01) |
| *H01H 1/50* | (2006.01) |

(52) U.S. Cl.
CPC ..... *H01H 71/2409* (2013.01); *H01H 73/045* (2013.01); *H01H 1/50* (2013.01); *H01H 71/2418* (2013.01); *H01H 2001/508* (2013.01)

(58) Field of Classification Search
USPC ..... 200/252
See application file for complete search history.

(56) References Cited

U.S. PATENT DOCUMENTS

| | | | | |
|---|---|---|---|---|
| 2009/0242373 | A1 | 10/2009 | Hustert et al. | |
| 2010/0019873 | A1* | 1/2010 | Mueller ..... | H01H 71/2409 335/6 |

FOREIGN PATENT DOCUMENTS

| | | | |
|---|---|---|---|
| DE | 102006054984 | A1 | 5/2008 |
| DE | 102006055007 | A1 | 5/2008 |
| DE | 102007015794 | A1 | 10/2008 |
| DE | 102008016036 | A1 | 10/2009 |
| EP | 2704171 | A1 | 3/2014 |

* cited by examiner

SWITCH UNIT, IN PARTICULAR A CIRCUIT BREAKER

FIELD OF THE INVENTION

The invention relates to a switch unit that forms a circuit breaker, and which includes a contact slide unit comprising a contact slide, a fixed contact piece and a moveable contact piece, and a short-circuit release that, in the event of a short-circuit, acts upon the moveable contact piece by means of a tappet.

BACKGROUND OF THE INVENTION

The functions of switch units, and more particularly those forming circuit breakers, include the provision of a safe breaking function for, in the event of a short-circuit, protecting both consumers and installations. Electrical or mechanical switch units are also suitable for the in-service manual switching of consumers, and for the safe isolation of an installation from the power grid for conduct of maintenance work or modifications to the installation. Electrical switch units are often electromagnetically operated.

Switch units of this type are accordingly highly-engineered electric switching devices with integrated protection for motors, cables, transformers and generators. They are employed in functional locations where a low frequency of switching is required. In addition to short-circuit protection, switch units of this type are also suitable for providing overload protection.

In the event of a short-circuit, an electrical switch unit safely disconnects an electrical installation. Fuse protection against overload is also thereby provided. Every conductor in which an electric current flows will heat up, to a greater or lesser extent. Such heating-up is dependent on the ratio of the current rating to the conductor cross-section, i.e., the "current density". The current density must not be excessively high, or excessive heat-up would otherwise result in charring of the conductor insulation or the possible start of a fire. In order to protect electrical installations against these damaging effects, switch units are employed as overcurrent protection devices.

Circuit breakers are provided with two independently-acting release mechanisms for overload and short-circuit protection, connected in series. Short-circuit protection is assumed by a virtually instantaneously-acting electromagnetic release. In the event of a short-circuit, the electromagnetic release immediately releases a latching mechanism of the circuit breaker. A switching armature separates the contact piece before the short-circuit current can reach its maximum value.

Known switch units comprise a contact slide unit with a contact slide and a moveable contact piece. The moveable contact piece is furthermore provided with electrical contacts. Switch units of this type are additionally provided with first contacts to a current conductor. In its closed state, the electrical contacts of the moveable contact piece are in contact with the fixed contacts of the switch unit. In the event of a short-circuit, the electrical contacts of the moveable contact piece are released from the fixed contacts, thereby interrupting the flow of electric current. The moveable contact piece is thus released or disengaged from the fixed contacts. In the event of short-circuit tripping in a switch unit, however, the moveable contact piece may be caused to rotate about its longitudinal axis after the moveable contact piece is released. Where the moveable contact piece rotates about its longitudinal axis, it is designated a rotating bridge element. In other words, following its rotation, the moveable contact piece does not return to its original position, but instead remains in its rotated position.

In many cases, known contact slides of contact slide units are provided with two guide systems, namely, an internal guide system and an external guide system. The external guide system is employed where the switching process, i.e. the making or breaking operation, is executed by means of a latching mechanism of the switch unit. In this case, no rotating bridge element results. The internal guide system is employed in the event of a short-circuit, if the switching process is executed by means of a switching armature, generally a tappet, on the switch unit. This means that, in the event of disconnection in response to a short-circuit, the moveable contact piece precedes the contact slide along the internal guide system, rebounds against the impact surfaces provided in the lower part of the switch unit and is then propelled back along the internal guide system. Accordingly, it is propelled in the opposing direction relative to the switching armature or tappet of the switch unit. It is therefore possible that the moveable contact piece and the tappet engage outside their respective mid-lines, thereby resulting in the rotation of the moveable contact piece around its longitudinal axis.

Upon the next switching operation of the switch unit, if the moveable contact piece remains in its rotated position, the contacts, specifically silver contacts of the moveable contact piece, will no longer engage with the fixed contacts of the switch unit, thus resulting in malfunctions. This means that the contact piece remaining in a rotated position is disadvantageous, in that the switch unit will then no longer be serviceable. A non-functioning contact piece and a non-functioning switch unit are disadvantageous for both the electrical consumer and the installation in which the switch unit is installed.

A further problem arises where, in the event of a short-circuit, the circuit breaker does not sufficiently rapidly interrupt the short-circuit current. Three time-staggered contact-opening mechanisms are employed for this purpose. A short-term and transient opening of contacts in response to a current flow is effected, first, by the application of current loop forces on the contact position between the fixed and moveable contact pieces and, second, by means of a pin that is electromagnetically driven by the short-circuit release. The permanent opening of contacts is effected by a disengageable mechanical kinematic chain, in combination with a switching lever.

It is accordingly problematic that if such high short-circuit currents occur, the time sequence of the contact-opening mechanisms no longer functions. In this case, the very high current loop forces present result in correspondingly rapid acceleration of the moveable contact piece, which will then rebound so rapidly from the limit stop of the housing that the contact will be reclosed before the latching mechanism can be maintained in the permanently open position by means of the switching lever. The destruction of the device may then ensue.

OBJECTS AND SUMMARY OF THE INVENTION

Accordingly, it is an object of the present invention to provide a switch unit that, even in the event of high short-circuit currents, will ensure reliable execution of the desired chronological sequence of contact-opening mechanisms.

In accordance with the invention, this object is fulfilled by a switch unit, as in the form of a circuit breaker, that includes a contact slide unit comprising a contact slide, a fixed contact piece and a moveable contact piece, and a short-circuit release that acts in the event of a short-circuit upon the moveable contact piece by means of a tappet.

The invention is characterized in that the switch unit further includes a moveable brake or braking device that is designed such that, in the event of a short-circuit, the moveable braking device dampens the return motion or movement of the rebounding moveable contact piece.

To this end, the invention exploits the physical principle of the exchange of energy associated with the impact of two bodies. In the event of a collision between two bodies, the velocities thereof will change in accordance with their relative masses. The contact piece rebounding from the housing collides with a mass. Accordingly, the velocity of the contact piece is significantly slowed, and consequently the time interval to its return arrival at the circuit-reclosing fixed contact position is extended. This time delay is sufficient for the latching mechanism to complete the path required for the permanent achievement of the minimum contact breaking gap.

In a particularly advantageous embodiment, the moveable contact piece may be guided on a guide element, wherein the moveable brake device is arranged above the moveable contact piece and at the upper end of the guide element. In accordance with the invention, the guide element is preferably configured as a guiding pin, and comprises a zone of substantial mass. The center of gravity is arranged above the moveable contact piece. Further to the current-driven disengagement of the contact piece by the tappet of the short-circuit release, the mass is displaced into the rebound path of the contact piece. The inevitable collision with the contact piece that is present on the rebound path is sufficient to generate the requisite time delay. This embodiment is advantageous in that installation is straightforward, and a guide function for preventing rotation of the bridge is also provided.

The moveable brake device may also be configured as a mass in the form of a flat punched metal element produced by die-stamping. This specific form of construction is advantageous in that die-stamped components are more cost-effective. Moreover, the flat profile of the metal element reduces the isolating distance between the two switching poles, i.e. the conducting side and the isolating side, far more effectively than an asymmetrical rotary element of equal mass. The installation space required is, moreover, reduced accordingly.

In a further implementation of the above-described embodiment, a further moveable brake device may be arranged additionally at the lower end of the guide element. Thus, in addition to the first mass, a second mass is positioned below the moveable contact piece. The two masses are interconnected to form a double mass, preferably by means of an opening in the switching bridge, and are also arranged for axial displacement in the contact opening direction. In the event of a current-driven opening of the contact bridge, the switching bridge, in its opening movement against the action of the contact load spring, will initially collide with the mass arranged below it, thereby accelerating the latter and reducing its own speed.

The bridge and the double mass are propelled to the limit stops of the housing, which may be different, and rebound therefrom. Advantageously, the housing limit stop of the double mass is further removed from the contact point than that of the contact bridge. As a result, the bridge will already be on its return trajectory and will collide once more with the still outwardly-moving double mass, thereby giving up a further proportion of its kinetic energy and further decelerating the bridge. The pre-tensioned contact load spring moves both elements back in the direction of contact. The advantage of this implementation of the invention stems firstly from its large speed damping capability, and secondly from the guide function of the bridge which prevents rotation.

In a further advantageous embodiment, the moveable brake device is arranged on the tappet of the short-circuit release. This implementation of the invention is characterized by its extreme ease of installation.

The switch unit according to the invention comprises a contact slide unit, with a contact slide as well as a fixed contact piece and a moveable contact piece, which are arranged opposite each other. A tappet of a short-circuit release is arranged above the contact slide unit. In an advantageous embodiment, a tubular extension is formed on the end of the tappet that faces the contact slide, the extension being either integral with the tappet or molded onto the tappet as a separate component. The tubular extension corresponds to or forms a part of the mass which forms the braking device.

The moveable contact piece is provided with an opening, in which the guide element is positioned. The guide element preferably comprises, above the moveable contact piece, a braking device that is implemented in the form of a mass. Preferably, a further additional mass can also be arranged, as a braking device, below the moveable contact piece on the guide element. In the event of operative tripping, the tappet of the short-circuit release moves in the direction of the moveable contact piece.

The invention is characterized in that, by the positioning of at least one additional mass which acts as a braking device, an exchange of energy results from the collision of two bodies, thereby reducing the speed of the moveable contact piece. The additional masses for the brake device according to the invention, in at least in some embodiments, are arranged on the guide element that guides the moveable contact piece. By this arrangement, the guide element fulfills a dual function. Firstly, it acts as a braking device that reduces the speed of the rebounding moveable contact piece in the event of tripping. Secondly, the guide element guides the moveable contact piece so as to reliably prevent any unintended rotation of the moveable contact piece resulting from the delivery of a high impulse of motion. Accordingly, even in the event of high short-circuit currents, the switch unit of the invention permits reliable execution of the chronological sequence of contact-opening mechanisms.

Further advantages and embodiments of the invention are described in greater below with reference to exemplary embodiments and to the accompanying drawings.

DETAILED DESCRIPTION OF THE PREFERRED EMBODIMENTS

Figure 1:
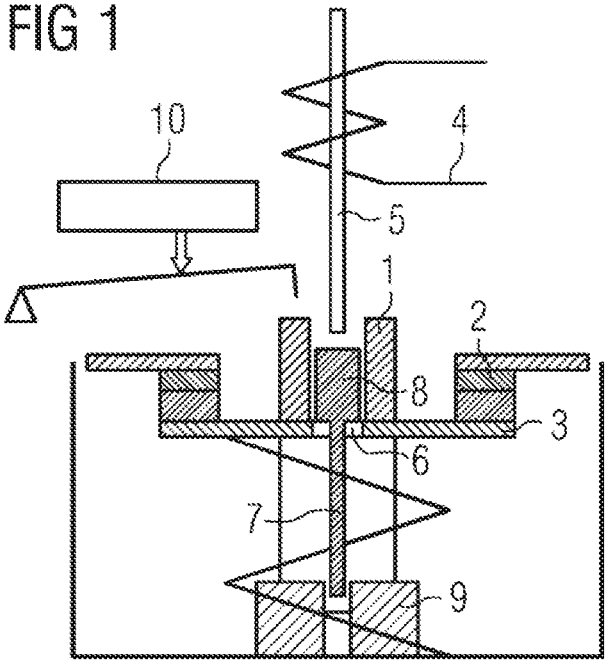
FIG. 1 is a schematic cross-sectional representation of a first exemplary embodiment of a switch unit according to the invention, with a contact slide and a short-circuit release, and including a braking device in the form of an additional mass, depicted in the closed state.

FIG. 1 depicts a first embodiment of a switch unit constructed in accordance with the invention, having a contact slide unit comprising a contact slide 1, a fixed contact piece 2, and a moveable contact piece 3, and a short-circuit release 4 that acts in the event of a short circuit upon the moveable contact piece 3 by means of a tappet 5. The moveable contact piece 3 is provided with an opening 6, through which a guide element 7 is routed. Above the moveable contact piece 3, the guide element 7 is configured with a mass 8 that is arranged on the moveable contact piece 3 such that, in the event of a short-circuit, it separates the moveable contact piece 3 from the fixed contact piece 2, if the tappet 5 engages with the mass 8.

The center of gravity of the mass 8 lies above the moveable contact piece 3. Below moveable contact piece 3, the guide element 7 may be guided either in the housing 9 or in the contact slide 1, or in a combination of housing 9 and contact slide 1.

FIG. 1 also depicts the disengageable mechanical kinematic chain in the form of a latching mechanism 10. The function of latching mechanism 10 is permanent maintenance of the contact bridge in the open position in the event of tripping.

Figure 2:
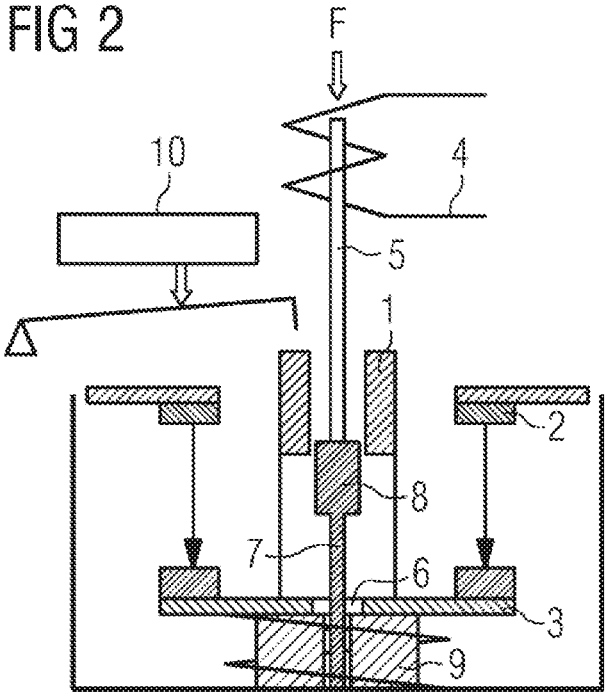
FIG. 2 is a schematic cross-sectional representation of the embodiment shown in FIG. 1, in the event of a short-circuit.

In FIG. 2, the contact slide unit of FIG. 1 is shown in the event of tripping. As there seen, the tappet 5 engages with the mass 8 of the guide element 7, such that the guide element 7 retracts into the guide of housing 9 thereby separating moveable contact piece 3 from fixed contact piece 2.

Figure 3:
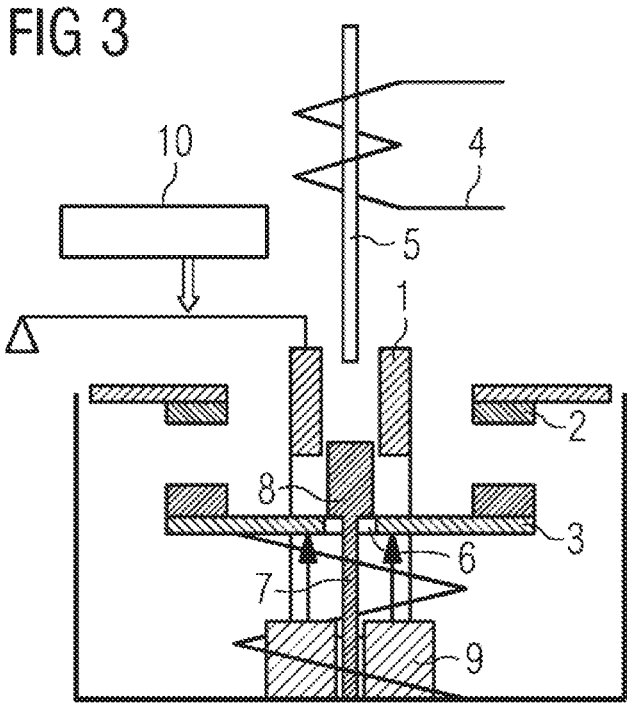
FIG. 3 is a schematic cross-sectional representation of the embodiment shown in FIGS. 1 and 2, during the reflex bridging action of the moveable contact piece on the braking device.

FIG. 3 depicts the embodiment shown in FIGS. 1 2 during the reflex bridging action of moveable contact piece 3 on the brake device, configured in the form of the mass 8 on guide element 7.

Figure 4:
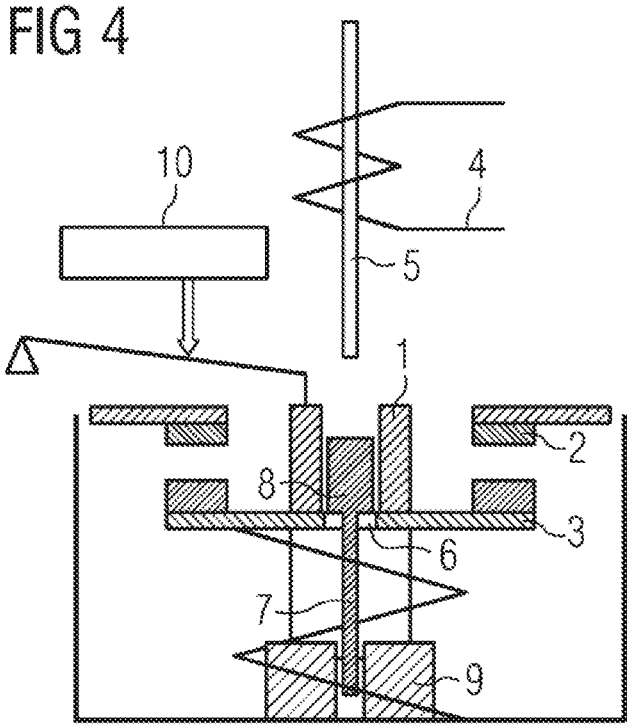
FIG. 4 is a schematic cross-sectional representation of the embodiment shown in FIGS. 1 to 3, with a contact position maintained in the open position by the latching mechanism.

FIG. 4 shows the embodiment of FIGS. 1 to 3 in which the contact bridge is maintained in the open position by latching mechanism 10.

Figure 5:
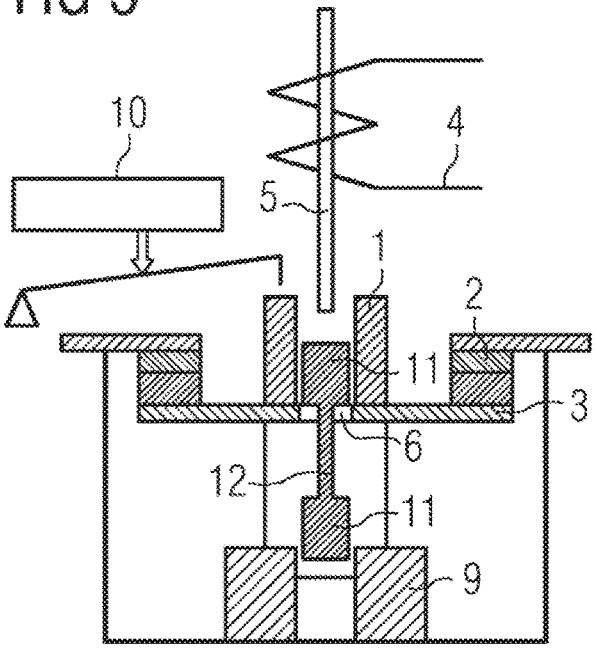
FIG. 5 is a schematic cross-sectional representation of a second embodiment of a switch unit according to the invention, with a contact slide and a short-circuit release, and including a braking device according in the form of a double mass, in the closed state.

In FIG. 5, a further, second embodiment of a switch unit constructed in accordance with the invention with a contact slide 1 and a short-circuit release 4, includes a brake device in the form of a double mass 11, shown in the closed state. As in the first embodiment of FIGS. 1 to 4, the contact slide unit comprises a contact slide 1, a fixed contact piece and a moveable contact piece 2, 3, and a short-circuit release 4 that acts in the event of a short circuit upon moveable contact piece 3 by means of a tappet 5. As in the first embodiment, the moveable contact piece 3 is also provided with an opening 6, through which a guide element 12 is routed. Above and below moveable contact piece 3, the guide element 12 is configured at its respective ends with a mass, which in this second embodiment implements the brake device in the form of a double mass 11. The mass above moveable contact piece 3 is configured such that, in the event of a short-circuit, it separates moveable contact piece 3 from fixed contact piece 2 if tappet 5 engages with the mass. The mass below moveable contact piece 3 is configured such that, in the event of tripping, it limits the movement of moveable contact piece 3. Accordingly, the guide for guide element 12 with double mass 11 in housing 9 is adapted to accommodate the mass below the moveable contact piece 3. FIG. 5 also includes the disengageable mechanical kinematic chain in the form of a latching mechanism 10. The function of latching mechanism 10 is permanent maintenance of the contact bridge in the open position in the event of tripping.

Figure 6:
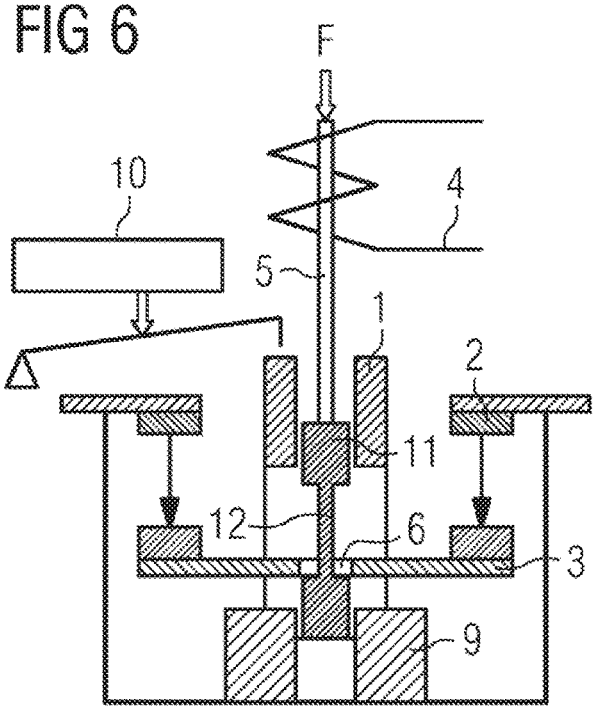
FIG. 6 is a schematic cross-sectional representation of the embodiment shown in FIG. 5, in the event of a short-circuit.

In FIG. 6, the contact slide unit of FIG. 5 is shown in the event of tripping. In that case, tappet 5 engages with the double mass 11 of guide element 12, such that guide element 12 retracts into the guide of housing 9, thereby separating moveable contact piece 3 from fixed contact piece 2.

Figure 7:
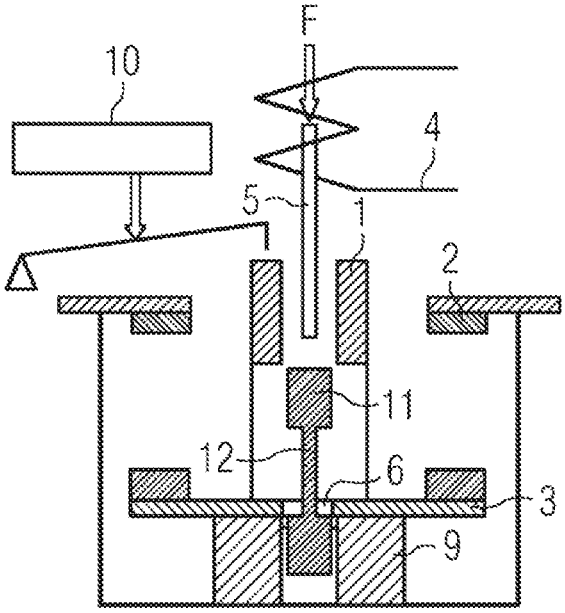
FIG. 7 is a schematic cross-sectional representation of the embodiment shown in FIGS. 5 and 6 in the event of a short-circuit, including the housing limit stop of the moveable contact piece.

FIG. 7 depicts the second embodiment of FIGS. 5 and 6 in the event of a short-circuit, whereby the movements of moveable contact piece 3 are limited firstly by the housing limit stop and secondly by the double mass 11 below moveable contact piece 3.

Figure 8:
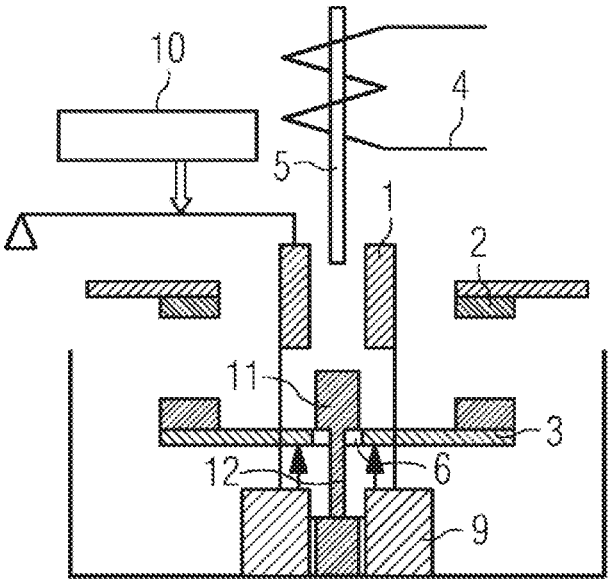
FIG. 8 is a schematic cross-sectional representation of the embodiment shown in FIGS. 5 to 7, during the reflex bridging action of the moveable contact piece on the braking device.

FIG. 8 shows the second embodiment of FIGS. 5 to 7 during the reflex bridging action of moveable contact piece 3 on the brake, configured in the form of a double mass 11 on guide element 12.

Figure 9:
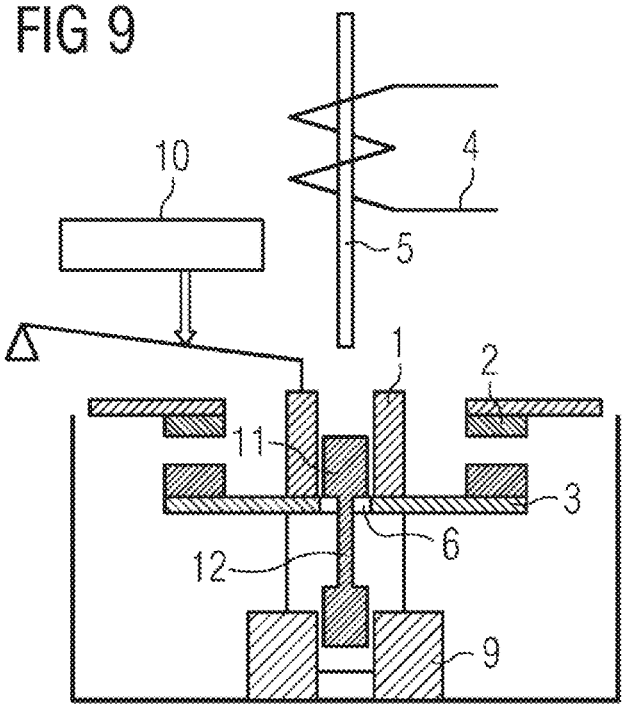
FIG. 9 is a schematic cross-sectional representation of the embodiment shown in FIGS. 5 to 8, with a contact position maintained in the open position by the latching mechanism.

In FIG. 9 of the embodiment depicted in FIGS. 5 to 8, the latching mechanism 10 maintains the contact bridge in the open position.

Figure 10:
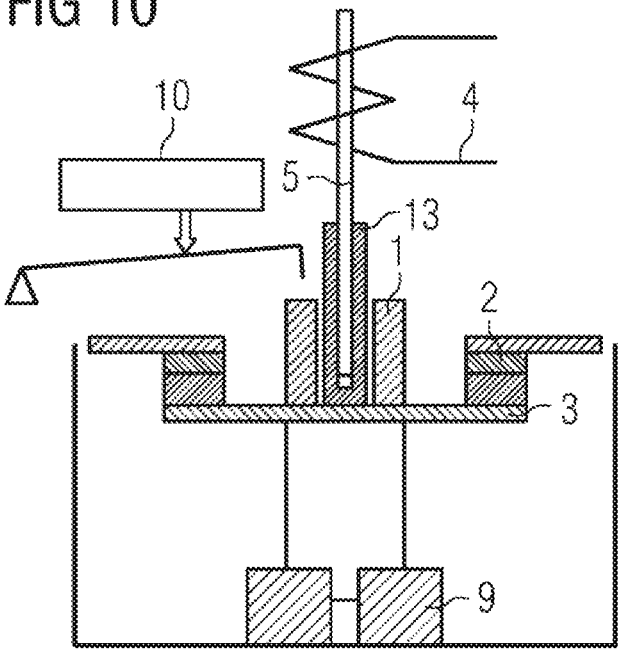
FIG. 10 is a schematic cross-sectional representation of a third embodiment of a switch unit according to the invention, with a contact slide and a short-circuit release, and including a braking device in the form of a tubular extension of the tappet of the short-circuit release, in the closed state.

FIG. 10 depicts a third embodiment of a switch unit in accordance with the invention that includes a contact slide 1 and a short-circuit release 4, and a brake device in the form of a tubular extension of the tappet 5 of the short-circuit release, shown in the closed state. As in the first and second above described embodiments, the contact slide unit comprises a contact slide 1, a fixed contact piece 2, a moveable contact piece 3, and a short-circuit release 4 that, in the event of a short-circuit, acts upon moveable contact piece 3 by means of a tappet 5. In this third embodiment, the brake device is configured as a tubular extension 13 that surrounds the end of tappet 5. FIG. 10 also depicts a disengageable mechanical kinematic chain in the form of a latching mechanism 10. The function of latching mechanism 10 is permanent maintenance of the contact bridge in the open position in the event of tripping.

Figure 11:
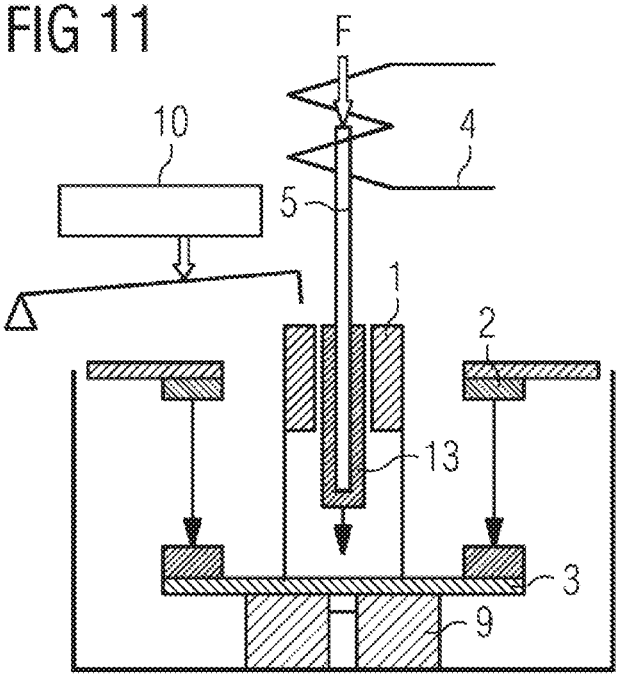
FIG. 11 is a schematic cross-sectional representation of the embodiment shown in FIG. 10, in the event of a short-circuit.

In FIG. 11, the contact slide unit of FIG. 10 is shown in the event of tripping. In that case, the tappet 5, including tubular extension 13, engages moveable contact piece 3 thereby separating moveable contact piece 3 from fixed contact piece 2.

Figure 12:
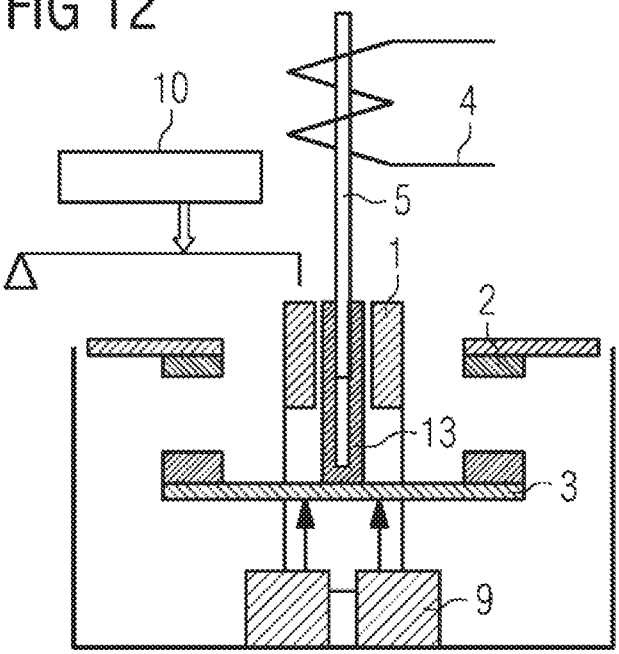
FIG. 12 is a cross-sectional representation of the embodiment shown in FIGS. 10 and 11, during the reflex bridging action of the moveable contact piece on the brake device.

FIG. 12 shows the third embodiment of FIGS. 10 and 11 during the reflex bridging action of moveable contact piece 3 on the brake device, configured in the form of the tubular extension 13 on tappet 5.

Figure 13:
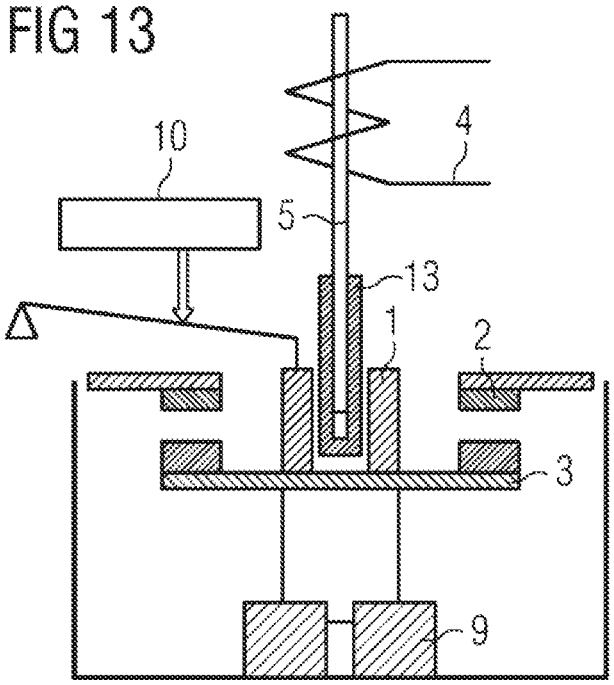
FIG. 13 is a cross-sectional representation of the embodiment shown in FIGS. 10 to 12, with a contact position maintained in the open position by the latching mechanism.

FIG. 13 depicts the third embodiment of FIGS. 10 to 12 with latching mechanism 10 maintaining the contact bridge in the open position.

Figure 14:
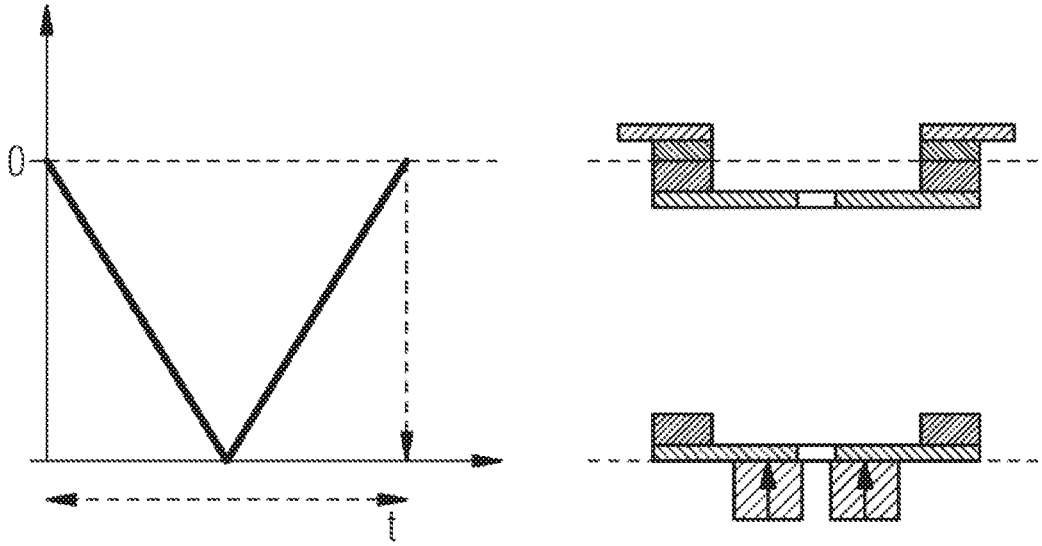
FIG 14 Prior art
FIG. 14 is a time vs. displacement graph for the moveable contact piece in a prior art construction.

FIG. 14 is a time vs. displacement graph for a moveable contact piece in accord with the prior art, and thus without a brake device of the present invention. As there seen, the time required for movement of the moveable contact piece in the direction of the housing limit stop is equal to that required for the return movement into reengagement with the fixed contact piece, i.e. the moveable contact piece executes this movement unbraked.

Figure 15:
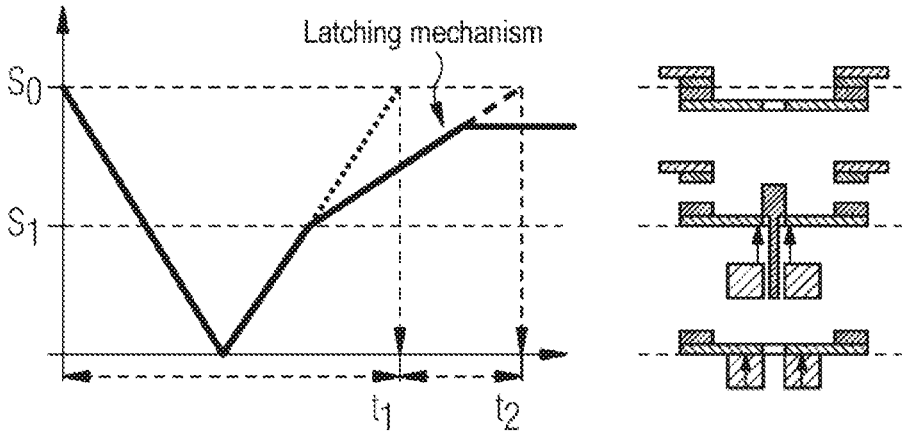
FIG. 15 is a time vs. displacement graph for embodiments of the present invention having an additional mass as a braking device, or with a tubular extension of the tappet as a braking device for the moveable contact piece.

The time vs. displacement graph of FIG. 15 is depicted for an embodiment of the switch unit constructed in accordance with the invention, which includes an additional mass as a braking device or a tubular extension on the tappet as a braking device for the moveable contact piece. As there shown, the path from initial contact engagement $S_0$ to the housing limit stop $S_2$ corresponds to the first part of the profile shown in FIG. 14. However, the subsequent path from the housing limit stop $S_2$ in the return direction toward contact engagement $S_0$ is different. In this case, there is a collision at point $S_1$ and, accordingly, an exchange of energy between the braking device and the moveable contact piece. The resulting additional interval or gain in time is depicted in the graph as the time interval $t_2$. As a result of the time delay generated by the braking device, the action of the latching mechanism is ensured.

Figure 16:
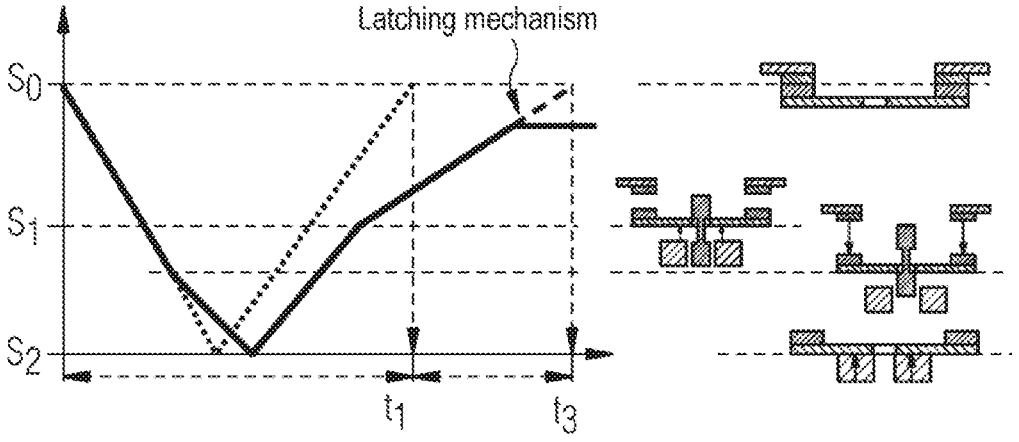
FIG. 16 is a time vs. displacement graph for an embodiment of the invention that includes a double mass as a braking device for the moveable contact piece.

FIG. 16 shows a time vs. displacement graph for the embodiment of the present invention that includes a double mass as the braking device for the moveable contact piece. In contrast to the graph shown in FIG. 15, there is an even longer time delay, identified in the graph by the interval $t_3$, associated with the two-fold collision between the upper mass and the moveable contact piece, and between the lower mass and the moveable contact piece. Here again, as a result of this time delay, the action of the latching mechanism is ensured.

Figure 17:
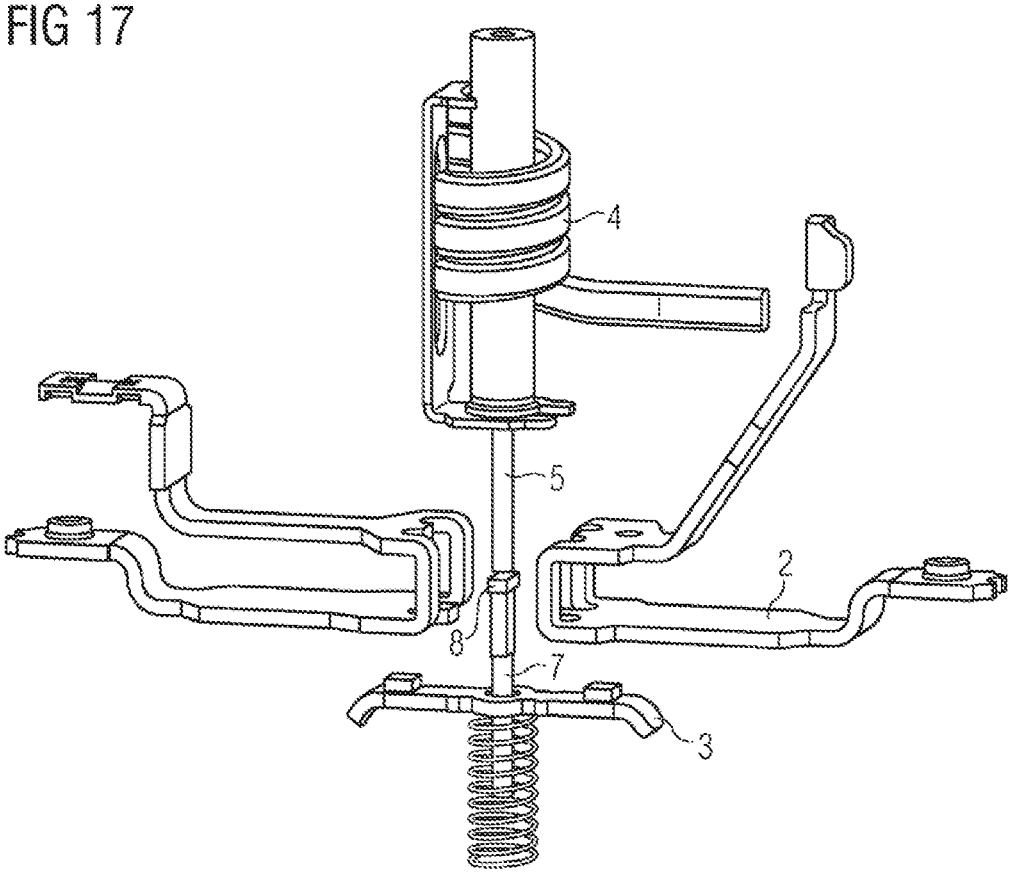
FIG. 17 is an elevated perspective view of an embodiment of a switch unit according to the invention with a short-circuit release and a braking device in the form of a mass formed of a flat punched metal element produced by die-stamping.

FIG. 17 shows a another switch unit constructed in accordance with the invention, having a fixed contact piece 2, a moveable contact piece 3, and a short-circuit release 4 that acts on moveable contact piece 3 by means of a tappet 5 in the event of a short-circuit. The guide element 7 is arranged above moveable contact piece 3 and is configured with a mass 8 on moveable contact piece 3 such that, in the event of a short-circuit, moveable contact piece 3 is separated from fixed contact piece 2 if tappet 5 engages with mass 8. In this further embodiment, the mass 8 is configured as a flat punched metal element produced by die-stamping.

The present invention is characterized in that, by the positioning of at least one additional mass that serves as braking device, an exchange of energy results from the collision of two bodies, thereby reducing the moving speed of the moveable contact piece. The additional masses for the braking device, in at least two embodiments herein disclosed, are arranged on the guide element that guides the moveable contact piece. By this arrangement, the guide element fulfills a dual function. Firstly, it acts as a braking device that reduces the speed of the rebounding moveable contact piece in the event of tripping. Secondly, the guide element guides the moveable contact piece such that any rotation of the latter due to the delivery of a high impulse of motion can be reliably prevented. Accordingly, even in the event of high short-circuit currents, a switch unit constructed in accordance with the present invention permits reliable execution of the chronological sequence of contact-opening mechanisms.

The invention claimed is:

1. A switch unit, comprising:

a contact slide unit, comprising a contact slide, a fixed contact piece and a moveable contact piece;

a tappet;

a short circuit release that, in response to a short-circuit condition, effects movement of the tappet to cause movement of the moveable contact piece in a first direction to disengage the moveable contact piece from the fixed contact piece to provide an open condition of the switch unit, and wherein the moveable contact piece is arranged for return movement in a second direction into re-engagement with the fixed contact piece to provide a closed condition of the switch unit;

a moveable braking device constructed so that, during the return movement of the moveable contact piece the moveable braking device dampens the return movement of the moveable contact piece; and a guide element arranged to guide the movement of the moveable contact piece along an exterior of the guide element, the moveable contact piece surrounding the guide element and having an opening through which the guide element is routed.

2. The switch unit of claim 1, wherein the moveable braking device comprises a mass disposed above the moveable contact piece and at an upper end of the guide element.

3. The switch unit of claim 2, wherein the mass of the moveable braking device comprises a flat punched metal element produced by die-stamping.

4. The switch unit of claim 1, wherein the moveable braking device comprises a double mass arranged above and below the moveable contact piece and proximate two opposite end regions of the guiding element.

5. The switch unit of claim 1, wherein the moveable braking device is arranged on the tappet.

6. The switch unit of claim 5, wherein the moveable braking device comprises a tubular extension that surrounds the tappet.

7. The switch unit of claim 1, wherein the switch unit comprises a circuit breaker.

8. The switch unit of claim 1, further comprising a spring for driving the return movement of the moveable contact piece in the second direction.

* * * * *